United States Patent [19]

Smolka

[11] 3,940,820

[45] Mar. 2, 1976

[54] DEVICE FOR CLEANING SHOE SOLES

[76] Inventor: Kurt Smolka, Wittenauerstrasse 82-86, Berlin, Germany, 26

[22] Filed: Jan. 24, 1975

[21] Appl. No.: 543,867

[30] Foreign Application Priority Data

Feb. 1, 1974 Germany ..... 2405423

[52] U.S. Cl. ..... 15/36

[51] Int. Cl.[2] ..... A47L 23/22

[58] Field of Search ..... 15/30–32, 34, 15/35, 36, 97 A

[56] References Cited

UNITED STATES PATENTS

| | | | |
|---|---|---|---|
| 2,933,752 | 4/1960 | McLennon | 15/36 X |
| 3,383,726 | 5/1968 | Chapin | 15/33 |

FOREIGN PATENTS OR APPLICATIONS

| | | | |
|---|---|---|---|
| 944,470 | 11/1948 | France | 15/36 |

*Primary Examiner*—Edward L. Roberts

*Attorney, Agent, or Firm*—V. Alexander Scher

[57] ABSTRACT

A device for cleaning shoe soles, which can be stepped over, includes a grid with cylindrical rings having engaged surfaces and forming circular passages through the grid. A frame encloses these rings and has vertical pins extending through the axes of the rings. The cleaning brushes are plate-like and ring shaped and are rotatable upon these pins. The brushes extend into the circular passages of the grid. The pins also carry upper round plates, whereby the plates and the rings constitute edge supports for the brushes.

7 Claims, 4 Drawing Figures

DEVICE FOR CLEANING SHOE SOLES

This invention relates to a cleaner of shoe soles, capable of being overstepped for cleaning purposes and provided with a grid with several passages, each of which contains a brush driven for rotation.

A shoe sole cleaner of this type known in the art has brushes shaped as rollers with horizontal axes. This construction has several drawbacks, namely, due to the cylindrical shape of the outer surface of the brushes and the flat upper surface of the grid, the contacting surfaces between brush and sole are comparatively small. The rotating brushes which are not engaged by the sole can throw the dirt which was not removed upwardly against the clothing of the user. Furthermore, the described geometrical relationship produces wedges along the outer line of the brushes which endanger the user, since they can clamp the heel. Furthermore, in this range, the brushes do not have any substantial resistance against bending since, in case of a load by the weight of the body, the specific size of the wedges is increased. In addition, since the known cleaner has several roller brushes upon a common axis located at the grid rods, the replacement of the brushes which are worn out is comparatively complicated.

There is another known sole cleaner providing for stationary cleaning of one shoe at a time and using a single roller brush or disk brush located upon a supporting surface inclined to the ground. There, the weight load is small, since the user supports his weight upon his other foot placed on the ground.

Another sole cleaner is also known which is also not stepped over by the user. In that cleaner, a single disk brush with a vertical axis is also provided, which is covered to a great extent by a cover plate. The user is supported upon this cover plate and he moves his shoe into the range of openings of the cover plate to clean his sole by the driven brush.

An object of the present invention is to improve shoe sole cleaners of the described type.

Another object is to provide a shoe cleaner of simple and strong construction with a safe and reliable operation and easy upkeep.

Other objects of the present invention will become apparent in the course of the following specification.

In the accomplishment of the objectives of the present invention, it was found desirable to provide a grid with cylindrical rings forming circular passages through the grid. A frame enclosing these rings has vertical pins extending through the axes of the rings. These pins carry rotatable cleaning brushes which are plate-like and ring-shaped. The brushes extend into the circular passages of the grid. The pins also carry round plates which, along with the rings, constitute edge supports for the brushes.

The frame may have an upper section consisting of these rings and a lower supporting plate in which the pins are fixed. The distance between the upper section and the lower plate is maintained by vertical supports. The rings may be provided with suitable coverings.

The described construction provides a rigid grid capable of resisting strong forces and providing great safety for the user. The produced cleaning surfaces are sufficiently large for cleaning purposes, but are sufficiently small to avoid the clamping of the shoes. This is also helped by a support of the brushes at their circumferential surfaces, which permits only a small change in the shape of the brushes. This support causes the brushes to extend continuously above surface of the grid, so that when suitable grind firm substances are selected, the grind stays within permissible limits. The support for the brushes is simple, cheap and reliable. Plates removably connected with the pins permit an easy exchange of the brushes when their bristles have been used up.

The provision of two supporting plates held by a vertical support has the advantage of providing a stable grid capable of resistance and having small weight and the possibility of easy manufacture. The required height is small, thus, a height of 80 mm is already sufficient to provide an efficiently operated shoe sole cleaner. Since the grid can be swung upwardly, all parts are easily accessible for operation and cleaning.

Larger device can be easily constructed by placing one next to the other several devices of the described type.

The invention will appear more clearly from the following detailed description when taken in connection with the accompanying drawings, showing diagrammatically and by way of example only, a preferred embodiment of the invention idea.

The illustrated shoe sole cleaner has a rectangular grid 1 supported in a rim 2. The rim 2 is introduced into the ground 3 in such a manner that the upper surface of the cleaner lies in the upper surface of the ground. At its lower surface, the rim 2 is provided with a plate 4 (FIG. 4), so that the rim with the plate forms a closed box which receives the removed dirt.

Figure 1:
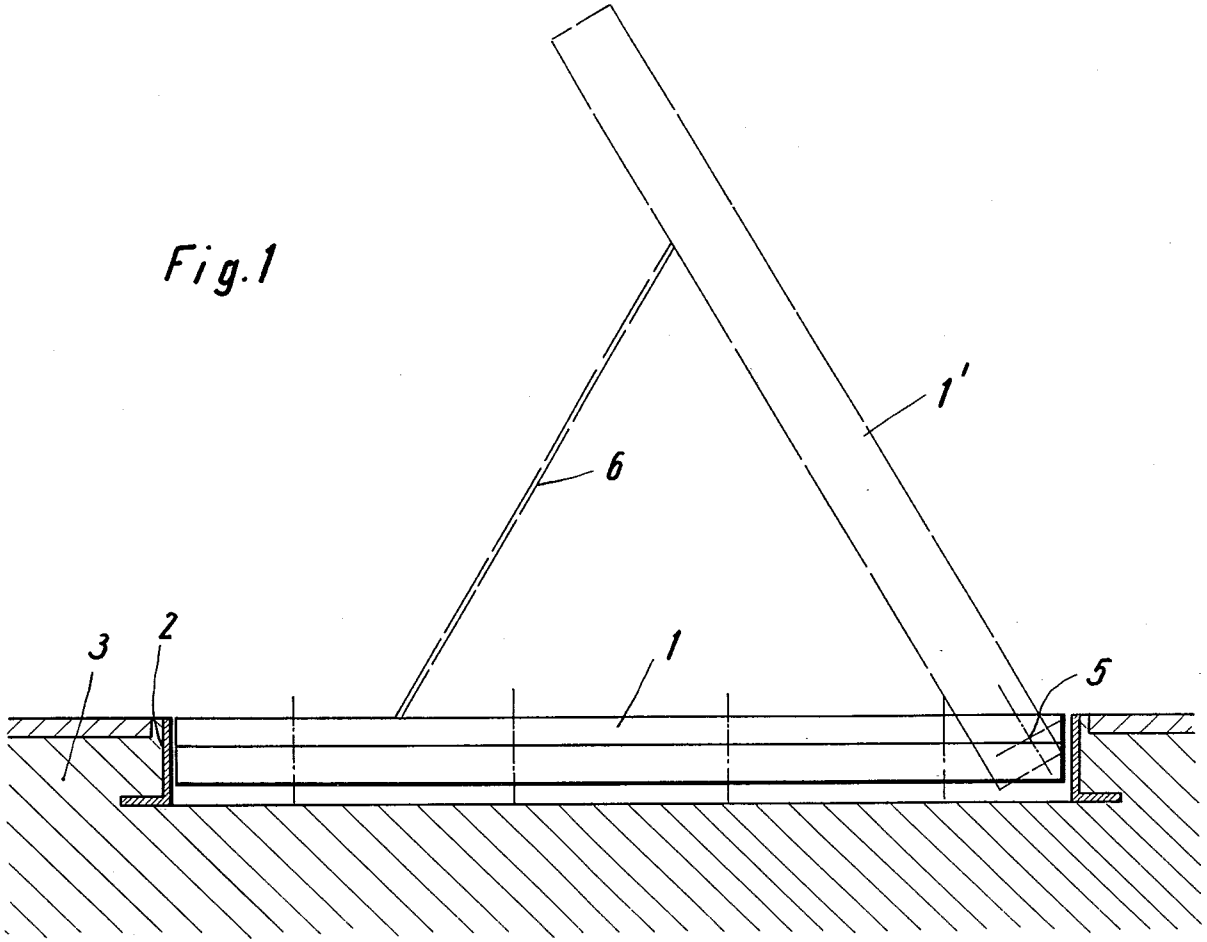
FIG. 1 is a side view of the built-in shoe sole cleaner of the present invention. It illustrates two operating positions of the cleaner.

The grid 1 is swingable upwardly about one of its longitudinal edges by a pivot 5 (FIG. 1) and is supported by a brace 6 in the upwardly raised position 1'. This provides easy accessibility to the cleaner for upkeep and the removal of dirt.

Figure 2:
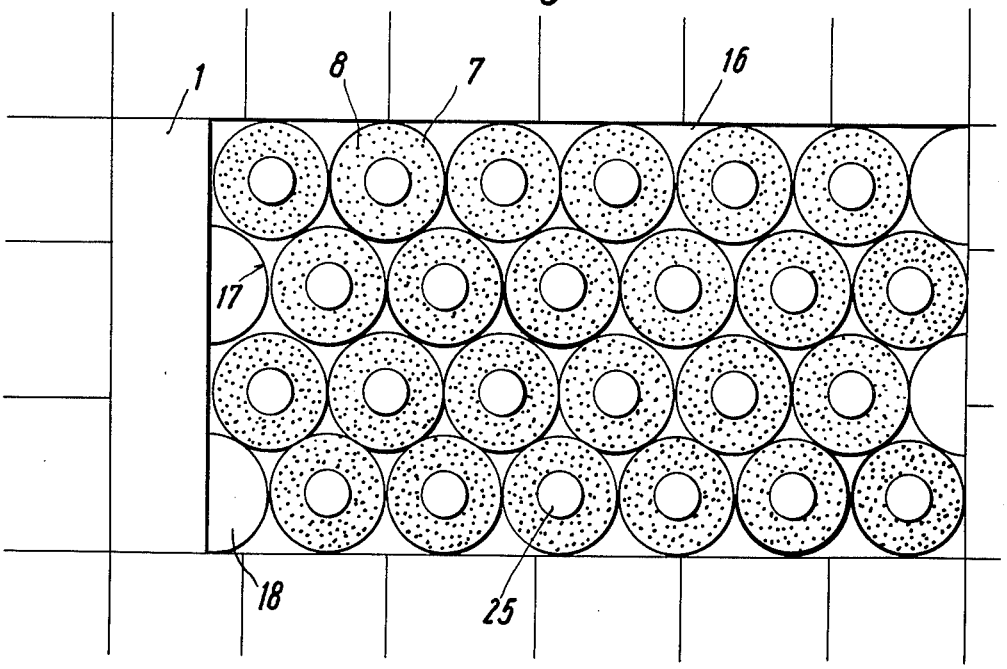
FIG. 2 is a top view of the cleaner.
Figure 3:
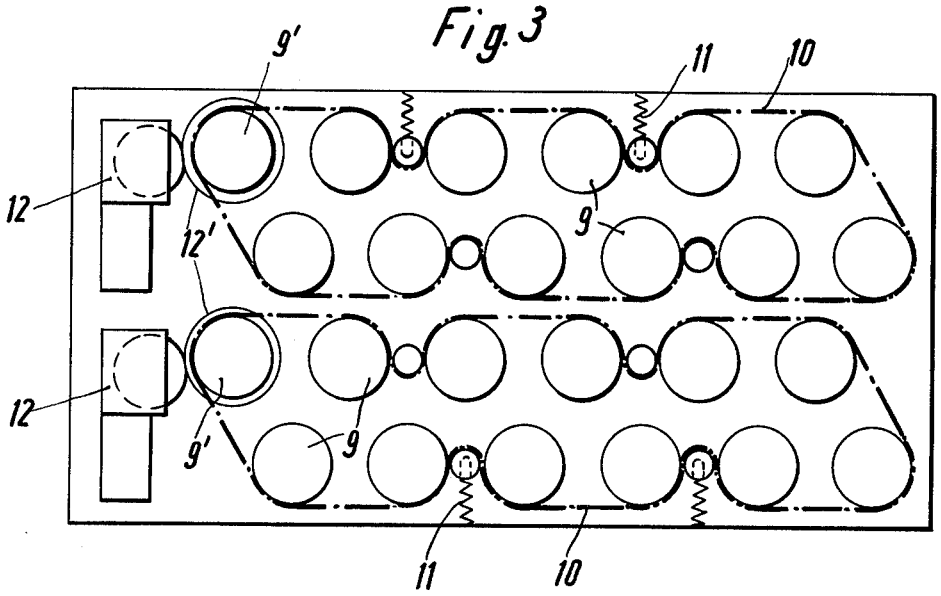
FIG. 3 is a diagrammatic top view illustrating the operation of the brushes.

As shown in FIG. 2, the upper surface of the grid contains ring-shaped openings 7, in which lie brush borders 8 rotatable about vertical axes and mounted upon disks 9 in a manner which will be described hereinafter. As shown in FIG. 3, there are two groups of disks 9, each provided with a separated drive. A separate V-belt is guided over the disks 9 of each group; it is engaged by tensioning devices 11 and is driven by an electrical motor 12. For that purpose, one of the disks 9' is provided additionally with a toothed ring 12'.

It is possible to provide a single drive for all disks, but it is preferable to provide a separation into groups, since then, in case one motor is damaged, a partial operation will still be possible.

The covering of the driving motors provides at the same time a strip over which a dog led by his master can be guided, since dogs are afraid to run over brushes.

Figure 4:
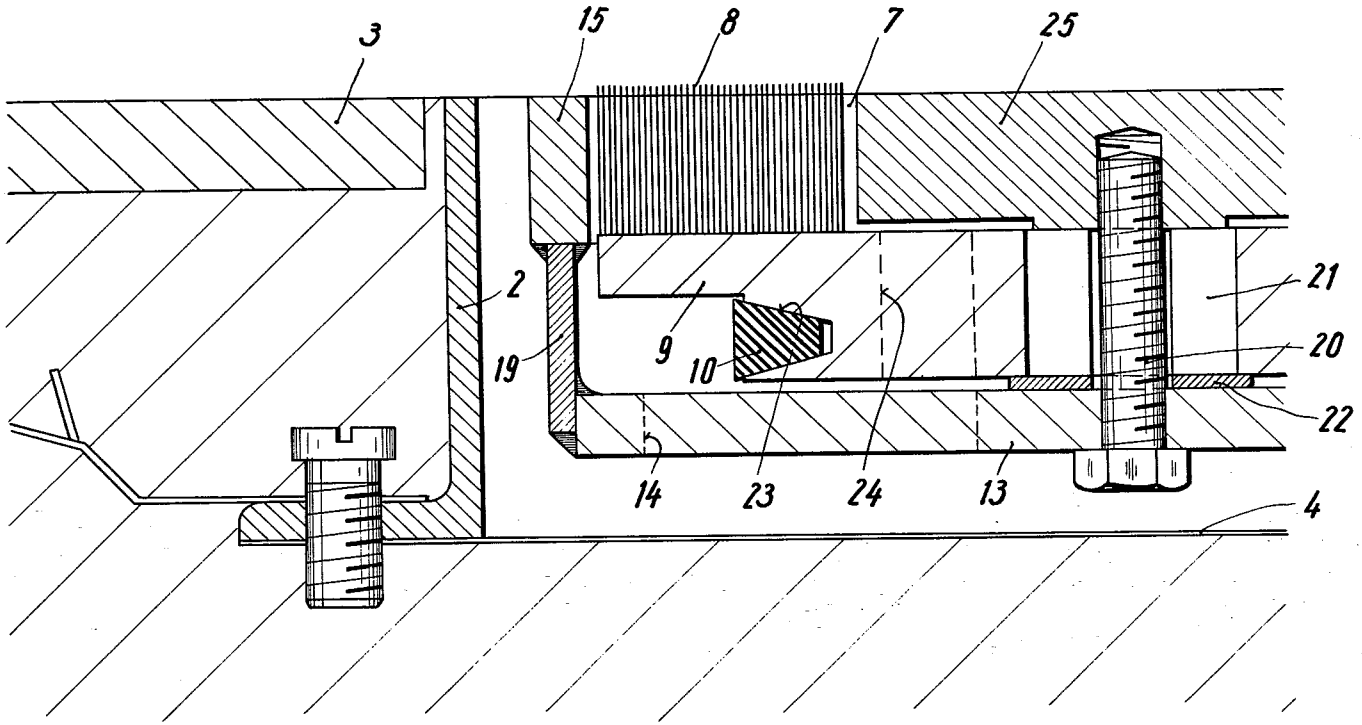
FIG. 4 is a partial vertical section on an enlarged scale.

Details of the construction are shown in FIG. 4. The grid 1 consists of an upper supporting plate and a lower supporting plate. The lower supporting plate 13 can have the shape of a grating with openings 14, through which dirt can drop. The upper supporting plate is composed of several rows of vertically extending cylindrical rings 15 which are soldered to each other at their interengaged covering locations and are enclosed by a frame 16. The inner surfaces of the rings form the inner circumferential surfaces of the ring-shaped passages 7. The rings of the individual rows are staggered relatively to each other so that half-rings 17 are provided to form a uniformly rigid upper supporting plate. The upper surfaces of the half-rings 17 as well as the wedges outside of the rings are closed by coverings 18.

The upper supporting plate is connected with the lower supporting plate 13 by supports 19. There are horizontally extending spacings between these supports to provide passage for the V-belts 10.

Vertical pins 20 are fixed in the lower supporting plate 13 in the axes of the rings 15 and extend into the range of these rings. A separate disk 9 is mounted upon a bearing 21 of each pin 20 and is freely rotatable thereon. A disk 22 is located under the bearing 21 and serves as a support. Each disk 9 includes a wedge-shaped groove 23 receiving the V-belt 10. A brush ring 8 is fixed upon the upper surface of the disk 9. Furthermore, the disk contains passages 24 for the removal of the stripped-off dirt.

The inner circumferential wall of each passage 7 is formed by a circular plate 25 which is screwed upon the pin 20 in such manner that the upper surface of the plate lies along the upper surface of the grid 1.

As shown in FIG. 4, the brushes 8 extend always above the upper surface of the grid and are supported at both circumferential surfaces of the passage 7.

I claim:

1. A device for cleaning shoe soles, comprising a grid having a lower supporting plate and an upper supporting plate, said upper supporting plate having rows of vertically extending cylindrical rings forming circular passages through the grid, vertical pins mounted in said lower supporting plate and extending through the axes of said rings, said upper supporting plate having round plates mounted upon said pins, ring-shaped brushes, and means mounting said brushes upon said pins for free rotation thereon, said grid passages containing said brushes, the edge of each round plate and the adjacent cylindrical ring, constituting circumferential limitations for a corresponding ring-shape brush.

2. A device in accordance with claim 1, comprising coverings fixed to the edges of said cylindrical rings and extending over wedge-shaped spaces between the rings.

3. A device in accordance with claim 1, wherein said means comprise discs carrying said brushes, each of said discs having a wedge-shaped groove, endless V-belts extending through said grooves and electrical motor means driving said V-belts.

4. A device according to claim 3, wherein said V-belt partially encloses said disks and drives them in the same direction.

5. A device according to claim 4, wherein in the brush-carrying disks are separated into two independent groups, the electrical motor means comprising a separate motor actuating each group.

6. A device according to claim 1, comprising a rim enclosing said grid and adapted to be placed within the ground, said grid having a cover swingable about a longitudinal edge of the grid.

7. A device according to claim 6, wherein said rim has a closed bottom.

* * * * *